United States Patent [19]

Bower, Jr.

[11] 4,327,947

[45] May 4, 1982

[54] KEEPER SPRING FOR CONNECTING MINING TOOL TO WORK TOOL HOLDER

[75] Inventor: Arnold B. Bower, Jr., Bristol, Va.

[73] Assignee: General Electric Company, Columbus, Ohio

[21] Appl. No.: 160,234

[22] Filed: Jun. 17, 1980

[51] Int. Cl.[3] ..... E21C 35/18

[52] U.S. Cl. ..... 299/86; 279/19.7; 299/92; 407/102; 411/517; 411/521

[58] Field of Search ..... 299/86, 92; 411/517, 411/521; 279/19.7; 407/102

[56] References Cited

U.S. PATENT DOCUMENTS

| | | | |
|---|---|---|---|
| Re. 29,900 | 2/1979 | Kniff | 299/92 X |
| 3,462,726 | 8/1969 | Stark et al. | 403/329 X |
| 3,519,309 | 7/1970 | Engle et al. | 299/86 |
| 3,752,515 | 8/1973 | Oaks et al. | 411/517 X |
| 3,767,266 | 10/1973 | Krekeler | 299/92 |

*Primary Examiner*—Ernest R. Purser

*Attorney, Agent, or Firm*—Hedman, Casella, Gibson & Costigan

[57] ABSTRACT

A keeper spring for mounting a rotatable mining tool in the bore of a supporting block is formed of a unitary, metallic spring material, and includes a cylindrical member which is split along its axial length so as to be radially expansible and contractable, thereby defining a first spring portion. Three, equally spaced elongated arcuate, leaf spring protuberances project radially outwardly of the central region of the cylindrical member and are aligned with the axial length of the cylindrical member. Each protuberance is formed by providing two parallel slits in the wall of the cylindrical member, after which the material intermediate the slits is indented outwardly so as to effectively define a second spring portion. When assembled on the shank of the mining tool, and disposed within the bore of the support block, the second spring portions engage an annular recess in the bore, and are maintained in the locked position by virtue of the resiliency of the leaf springs in addition to the resiliency of the cylindrical member.

8 Claims, 5 Drawing Figures

KEEPER SPRING FOR CONNECTING MINING TOOL TO WORK TOOL HOLDER

This invention relates to resilient keeper springs, and is particularly concerned with a split resilient keeper spring for mounting in the groove on the shank of a mining tool for detachably retaining the tool in a support block therefor.

BACKGROUND OF THE INVENTION

In the field of mining, excavating and earth working machinery, holders are fixed to the machinery for presenting bits or teeth in proper working positions so they may be driven against the face of the material to be mined, excavated or worked. One type of bit member utilized for mining purposes is in the form of a pick-like bit member, the body of which is symmetrical about a longitudinal axis and has a shank at one end for support of the body, and is tapered inwardly at the other end where there is provided a hard region or a hard insert, such as a cemented tungsten carbide insert. In the use of the pick-up bit member, it has been found that the bit members or the inserts wear rapidly and must frequently be removed and reconditioned or replaced. This involves expensive down time of the machine using the bit member and greatly interferes with maintaining the proper rate of production.

To facilitate the replacement of bit members it has been known to form the shank of the elongated bit member with an annular groove in which is mounted a split-type keeper ring that is held captive on the shank. The keeper ring is usually formed with projections which aare received in recesses in the body which opens into the bore to hold the bit member in the supporting body. Examples of prior art resilient keeper rings are disclosed in U.S. Pat. Nos. 3,519,309; 3,752,515; and 3,767,266.

Heretofore, prior art keeper rings have been provided with radially spaced, circumferentially located projections in the form of dimples or the like, and such projections engage recesses in the bore of the support block merely due to resiliency of the ring wall. Accordingly, it would be of significant advantage to provide a keeper spring having increased or redundant spring resiliency for maintaining the bit member within the supporting holder, and such an advantage is an object of the present invention.

DESCRIPTION OF THE INVENTION

According to the present invention, there is provided a new and improved keeper spring for mounting a rotatable mining tool in the bore of a support block. The combination of the supporting block, the mining tool, and the keeper spring is held together by the resilient keeper spring which is of unitary construction, and is made of metallic spring material. The keeper spring is generally cylindrical in configuration and is disposed about a shank of the mining tool, and the keeper spring preferably includes three, equally spaced, arcuate leaf spring protuberances which project radially outwardly of, and axially aligned with the central axis of the cylindrical member. The latter is split so as to define a first spring portion that is radially expansible and contractable, while the leaf spring protuberances define a second spring portion. In the assembled condition of the subject keeper spring, the cylindrical body portion of the keeper spring maintains the keeper spring in a groove provided in the shank of the mining tool, while the leaf spring protuberances are disposed in a complementary annular recess formed in the bore of the support block. At such time, the resilient biasing forces of the first spring portion and the second spring portions are effective to limit axial movement of the mining tool relative to the supporting block, thereby providing a redundant and enhanced efficiency resilient keeper spring. Furthermore, the leaf spring protuberances provide a more positive location and fit of the subject keeper spring against the internal bore of the supporting block.

DESCRIPTION OF THE PREFERRED EMBODIMENT

Figure 1:
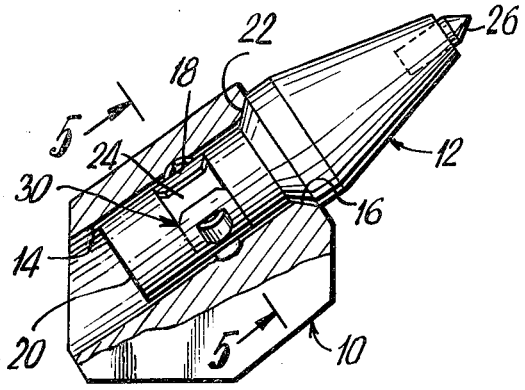
FIG. 1 is an elevational view, partly in section, of a pick-type mining tool in a support block therefor, with a resilient keeper spring according to the present invention mounted on the shank of the tool.

Turning to FIG. 1, a support block 10 for a pick-type bit or tool 12 is adapted to be welded or otherwise suitably affixed to a driving device such as a disk or chain or other mining machine device for driving bit 12 against the surface of the material to be mined. The supporting block 10 includes a bore 14 having a tapered mouth portion 16, and is provided, intermediate its length, with a circumferential recess or internal annular groove 18 (see FIG. 5). The pick-type bit 12 includes at one end thereof a shank 20 of a diameter smaller than the diameter of the bore 14, and intermediate tapered seat portion 22 which is complimentary to the tapered mouth 16 of the bore 14. Furthermore, cut into the shank 20 is a shallow annular groove 24, while at the opposite end of the pick-type bit 12 there is mounted a hard wear resistant element 26 formed of, for example, cemented tungsten carbide.

Figure 2:
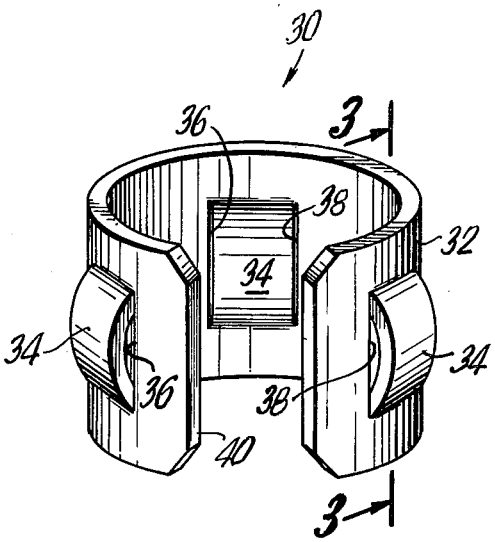
FIG. 2 is a perspective view of the keeper spring of the subject invention.
Figure 3:
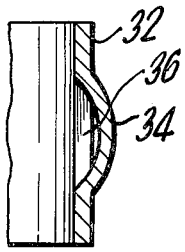
FIG. 3 is a cross-sectional view of the keeper spring of the subject invention taken along line 3—3 in FIG. 2.

Disposed about the shank 20, and more particularly resiliently engaging the shank in the annular groove 24 is the keeper spring of the subject invention, generally designated by the numeral 30. As more particularly illustrated in FIGS. 2, 3, and 4, the keeper spring 30 is preferably made of a metallic spring material, and includes a generally cylindrical body portion 32 which is axially split, as at 40. Accordingly, the cylindrical body member 30, being made of a metallic spring material, is radially and contractable, with the axial length of the body 32 substantially corresponding to the axial length of the annular groove 24 in the shank 20. Hence, when assembled on the bit 12, the opposite edges of the body portion 32 are adjacent the side walls of the shallow annular groove 24, as shown in FIG. 1, so that the keeper spring 30 may rotate freely within the groove 24.

Figure 4:
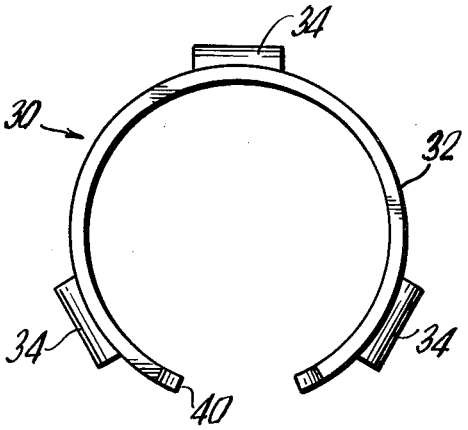
FIG. 4 is a top elevational view of the keeper spring of the subject invention.

The resilient body member 32 is slotted or slit along spaced parallel lines 36, 38 about the circumference thereof, after which the portion of the body member intermediate each pair of slits 36, 38 is reversely indented to define an elongated, arcuate leaf spring protuberance 34 which projects radially outwardly of, and is axially aligned with the cylindrical body portion 32. As shown in FIG. 4, three elongated, arcuate leaf spring protuberances 34 are equally spaced about the circumference of the cylindrical member 32. By this arrangement, and in view of the fact that the keeper spring 30 is made of a metallic spring material, each protuberance 34 effectively defines a projecting leaf spring which is capable of deflection in a radial direction, and thus capable of providing a resilient biasing force in the radial direction. In view of the remaining structure of the cylindrical member 32, when the leaf spring protuberances 34 are radially deflected inwardly, under a biasing force, the keeper spring 30 maintains its original axial dimensions, save for the radial deflections of the leaf spring protuberances 34. In other words, the construction of the keeper spring 30 is such that the latter does not elongate when a radially biasing force is applied thereto. Still further, by virtue of the resilient expansible and contractable characteristics of the cylindrical member 32, and the leaf spring protuberances 34, a first spring portion and second spring portions are respectively provided in each keeper spring 30. Accordingly, a redundant spring system is inherently provided in the keeper spring 30, and such redundant spring system enhances the retention capabilities of the keeper spring in maintaining the bit member 12 within the supporting block 10.

Figure 5:
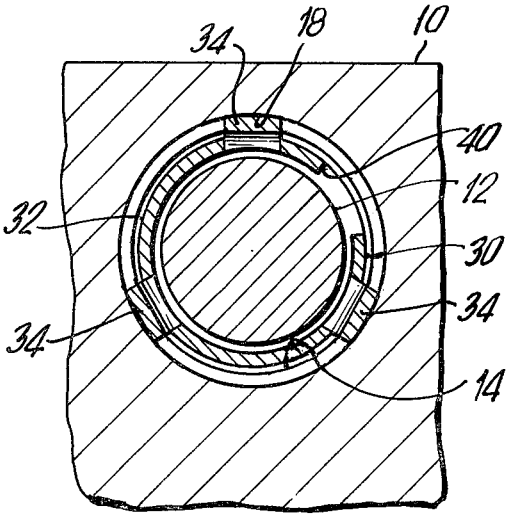
FIG. 5 is a cross-sectional view taken along line 5—5 in FIG. 1.

Referring to FIGS. 1 and 5, in the assembly of the combination of the supporting block 10, pick-like bit 12, and the keeper spring 30, the latter is radially expanded and forced over the shank 20 so as to resiliently engage the annular groove 24, with the spring biasing retention force of the cylindrical member 32 maintaining the keeper spring in engagement with the shank 20. The bit 12 is then inserted into the bore 14 until such time as the leaf spring protuberances 34 engage and interlock with the complimentary internal annular recess 18 in the bore 14 (see FIG. 5). The spring characteristic of the protuberances 34 insure a more positive location of the protuberances within the annular recess 18, as well as an improved fit of the keeper spring, and hence the bit 12, in the internal block bore 14. In the final assembled condition of the bit within the supporting block 10, the bit 12 may be rotated about its longitudinal axis whereas axial displacement of the bit relative to the supporting block is restrained by virtue of the biasing forces of the keeper spring 30.

It is to be understood that changes may be made in the particular embodiment of the invention in light of the above teachings, but that these will be within the full scope of the invention as defined by the appended claims.

What is claimed is:

1. A keeper spring for mounting a rotatable mining tool in the bore of a support block comprising a generally cylindrical member made of a metallic spring material, said cylindrical member being split along the axial length thereof to define a first spring portion that is radially expansible and contractible, and said cylindrical member including a plurality of second spring portions disposed on the circumference thereof, each second spring portion being an elongted arcuate leaf spring protuberance having each end joined to said cylindrical member and having the opposite side edges thereof being defined by two parallel slits cut into said cylindrical member, each said second spring portion projecting radially outward of, and axially aligned with, said cylindrical member, the portions of said cylindrical member between said second spring portions being continuous cylindrical arcs having radii equal to the radii of the portions of said cylindrical member on either end of said protuberances.

2. A keeper spring for mounting a rotatable mining tool in the bore of a support block as a claim 1 wherein said keeper spring is of unitary construction.

3. A keeper spring for mounting a rotatable mining tool in the bore of a support block as in claim 1 wherein three leaf spring protuberances are provided and are uniformly spaced about the circumference of said cylindrical member.

4. A keeper spring for mounting a rotatable mining tool in the bore of a support block as in claim 1 wherein said protuberances project radially outwardly from said cylindrical member from the axially central region of the cylindrical member.

5. A unitary, resilient keeper spring for use as a captive keeper on the shank of a tool for retaining the tool in assembled relation with a support block therefore comprising:

a generally cylindrical member made of metallic spring material, said cylindrical member being split axially from end to end to define a first spring portion that is radially expansible and contractable, said cylindrical member including second spring portions comprising three elongated, arcuate leaf spring protuberances projecting radially outwardly of, and axially aligned with, said cylindrical member, said protuberances being uniformly spaced about the circumference of said cylindrical member and projecting outwardly from the axial central region of said cylindrical member, the opposite side edges of each protuberance being defined by two parallel slits cut into said cylindrical member, the portions of said cylindrical member between said second spring portions being continuous cylindrical arcs having radii equal to the radii of the portions of said cylindrical member on either end of said protuberances.

6. The combination of a supporting block and pick-like bit member freely rotatably therein, hard inserted elements at one end thereof and cylindrical shank at the opposite end thereof, the shank being formed with an annular groove, said supporting body having a bore receiving said shank and formed with a recess opening in said bore, a keeper spring for rotatably mounting said pick-like bit member in said bore, said keeper spring comprising a generally cylindrical member made of a metallic spring material, said cylindrical member being split along the axial length thereof to define a first spring portion that is radially expansible and contractible, and said cyindrical member including a plurality of second spring portions disposed on the circumference thereof, each second spring portion being an elongaed arcuate leaf spring protuberance having each end joined to said cylindrical member and having the opposite side edges thereof being defined by two parallel slits cut into said cylindrical member, said second spring portion projecting radially outwardly of, and axially aligned with, said cylindrical member, the portions of said cylindrical member between said second spring portions being continuous cylindrical arcs having radii equal to the radii of the portions of said cylindrical member on either end of said protuberances, said keeper spring assembled on said shanking said groove and maintained in contact thereto by said first spring portion, said keeper spring as mounted on said shank being disposed within said bore of the supporting body, with the leaf spring protuberance disposed in said recess whereby the said second spring portion of the keeper spring is effective to limit axial movement of the bit member relative to the supporting body.

7. The combination of claim 6 in which the annular groove in the shank is shallow and has side walls normal to the bottom thereof, with the opposite ends of said keeper spring disposed adjacent said side walls.

8. The combination of claim 6 wherein three protuberances are provided and are uniformly spaced about the circumference of said cylindrical member, and wherein said recess in the bore is annular.

* * * * *

UNITED STATES PATENT AND TRADEMARK OFFICE

CERTIFICATE OF CORRECTION

PATENT NO. : 4,327,947

DATED : May 4, 1982

INVENTOR(S) : Arnold B. Bower, Jr.

It is certified that error appears in the above—identified patent and that said Letters Patent is hereby corrected as shown below:

Claim 6, column 4, line 66, delete "shanking" and substitute therefor --shank in--.

Signed and Sealed this

*Fourteenth* Day of *September 1982*

[SEAL]

*Attest:*

GERALD J. MOSSINGHOFF

*Attesting Officer*

*Commissioner of Patents and Trademarks*